US008281852B2

(12) United States Patent
Mackenzie

(10) Patent No.: US 8,281,852 B2
(45) Date of Patent: Oct. 9, 2012

(54) COILED TUBING QUICK CONNECT

(75) Inventor: Gordon R. Mackenzie, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 231 days.

(21) Appl. No.: 12/501,161

(22) Filed: Jul. 10, 2009

(65) Prior Publication Data

US 2010/0071892 A1 Mar. 25, 2010

Related U.S. Application Data

(60) Provisional application No. 61/082,719, filed on Jul. 22, 2008.

(51) Int. Cl.
*E21B 17/02* (2006.01)

(52) U.S. Cl. ... 166/85.1; 166/382; 166/77.2; 166/77.51; 166/242.6

(58) Field of Classification Search ..... 166/382, 166/381, 360, 338, 77.1, 77.2, 77.51, 85.1, 166/242.6; 285/913, 402, 412
See application file for complete search history.

(56) References Cited

U.S. PATENT DOCUMENTS

| | | | | |
|---|---|---|---|---|
| 909,131 | A * | 1/1909 | Antic | 285/148.14 |
| 2,907,591 | A * | 10/1959 | Gulick | 285/148.14 |
| 5,417,291 | A * | 5/1995 | Leising | 175/320 |
| 5,803,175 | A | 9/1998 | Myers, Jr. et al. | |
| 6,601,652 | B1 | 8/2003 | Krueger et al. | |
| 6,761,574 | B1 | 7/2004 | Song et al. | |
| 7,059,881 | B2 * | 6/2006 | Song et al. | 439/191 |
| 7,172,038 | B2 | 2/2007 | Terry et al. | |
| 7,210,524 | B2 | 5/2007 | Sloan et al. | |
| 7,231,982 | B2 | 6/2007 | Sloan et al. | |
| 7,779,935 | B2 * | 8/2010 | Jagert et al. | 175/321 |
| 2002/0029907 | A1 * | 3/2002 | Carriere et al. | 175/57 |
| 2007/0062707 | A1 * | 3/2007 | Leising et al. | 166/380 |
| 2008/0047716 | A1 * | 2/2008 | McKee et al. | 166/384 |
| 2010/0270789 | A1 | 10/2010 | Surveyor et al. | |

OTHER PUBLICATIONS

Sas-Jaworsky II, et al., "Coled tubing 1995 update: Production applications", World Oil, Jun. 1995, 97-105.
Walker, Tim, et al., "Downhole Swab Valve Aids in Underbalanced Completion of North Sea Well", SPE 30421, 1995, 1-3.
Walker, Tim et al., Underbalanced Completions Improve Well Safety and Productivity: World Oil, Nov. 1995, 4 pages.
Portman, L., et al., "Don't Break the Wellhead", SPE 94333, Apr. 2005, 1-13.
Blount, C. G., "Inflatable CT Conveyed Selective Well Testing System for Logging OPenhole and Horizontal Wellbores: Development and Use", SPE 81718, Apr. 2003, 1-11.
Mackenzie, Gordon R.J., et al., "Through-Tubing Inflatables: Isolation and Guidelines for Coiled-Tubing Applications", SPE 54476, May 1999, 1-14.
McClatchie, D.W., et al., "Applications Engineering for Composite Coiled Tubing", SPE 54507, May 1999, 1-8.

* cited by examiner

*Primary Examiner* — Cathleen Hutchins
(74) *Attorney, Agent, or Firm* — Steve Rosenblatt

(57) ABSTRACT

A bottom hole assembly supported by coiled tubing has components attached to each other with quick connections that do not require threading to provide the integral connection capable of supporting the BHA's required, torque, tensile and pressure loads. This quick connect feature provides torque transmission capability and does not need rig equipment such as tongs for makeup. Connecting the components is faster and safer particularly when the connections have to be made well above a rig floor. The lower end of the coiled tubing connector can also be provided with a quick connection half to mate with the uppermost tool in the bottom hole assembly.

13 Claims, 2 Drawing Sheets

COILED TUBING QUICK CONNECT

PRIORITY INFORMATION

This application claims the benefit of U.S. Provisional Application No. 61/082,719, filed on Jul. 22, 2009.

FIELD OF THE INVENTION

The field of the invention is bottom hole assemblies that are run on coiled tubing where the components are connected to each other with non-threaded connections.

BACKGROUND OF THE INVENTION

Downhole operations are accomplished with bottom hole assemblies that include one or more tools that are positioned in the wellbore on a tubular string. Rigs of various types are available for assembling the tubular string using tongs to make up threaded joints when rigid tubing is used to support the bottom hole assembly (BHA).

Certain applications allow the use of coiled tubing which has advantages of elimination of the connections within the tubing itself and feeding the tubing off a coil into the wellbore. Many times when coiled tubing is to be used at a well site there is no rig available to make up threaded joints. While coiled tubing saves time otherwise used to make up joints in threaded rigid tubing by elimination of such joints, the reality is that the components of a bottom hole assembly that the coiled tubing will have to support are still connected with pin and box threaded connections. Some of these connections need to be made up fairly high in the air bringing a variety of safety issues into play. Making up connections in the bottom hole assembly that are threaded takes a long time and can become a significant cost to the well operator. In many cases specialized tong units are required to be mobilized to correctly make up said connections.

Quick connections have been used in conjunction with coiled tubing to connect associated signal and power electrical lines. Some examples of such auxiliary quick connections are shown in U.S. Pat. Nos. 6,601,652, 6,761,574 and 7,172,038. What has not been used before are non-threaded quick connections that can transmit torque in connection with making up components of a bottom hole assembly to each other. These and other aspects of the present invention will be more apparent to one of ordinary skill in this art from a review of the description of the preferred embodiment and the associated drawing while recognizing that the full scope of the invention is to be determined from the claims.

SUMMARY OF THE INVENTION

A bottom hole assembly supported by coiled tubing has components attached to each other with quick connections that do not require threading to provide the integral connection capable of supporting the BHA's required, torque, tensile and pressure loads. This quick connect feature provides torque transmission capability and does not need rig equipment such as tongs for makeup. Connecting the components is faster and safer particularly when the connections have to be made well above a rig floor. The lower end of the coiled tubing connector can also be provided with a quick connection half to mate with the uppermost tool in the bottom hole assembly.

DETAILED DESCRIPTION OF THE PREFERRED EMBODIMENT

Figure 1:
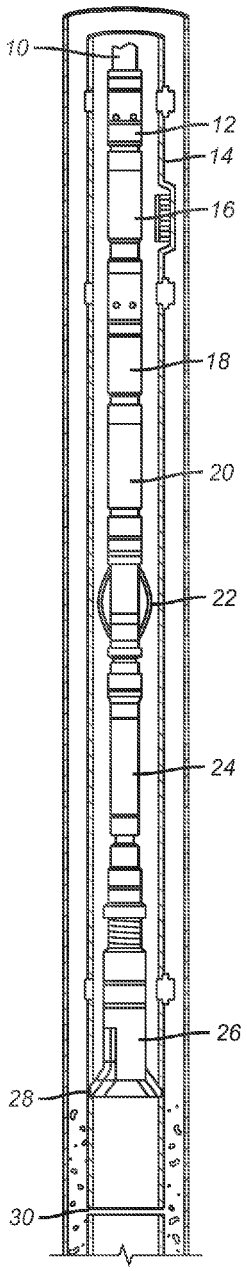
FIG. 1 is an elevation view of a bottom hole assembly that can be run in on coiled tubing where the components are quick connected to each other.

FIG. 1 illustrates a bottom hole assembly (BHA) that is supported from coiled tubing 10. The coiled tubing 10 has a connector 12 at its lower end. Below connector 12 can be a variety of tools and FIG. 1 is simply illustrative of a series of tools that can be connected to each other to form the BHA. The BHA is shown inside a production string 14 as an example of an application of the present method. The string includes a dual back pressure valve 16 followed by a hydraulic disconnect 18, a circulating sub 20, a hydraulic centralizer 22, a downhole motor 24 and a tubing cutter 26. Two cuts 28 and 30 are shown as having been made by the cutter 26. Those skilled in the art will appreciate that additional, fewer and/or different tools can be used in a BHA using the present invention.

Figure 2:
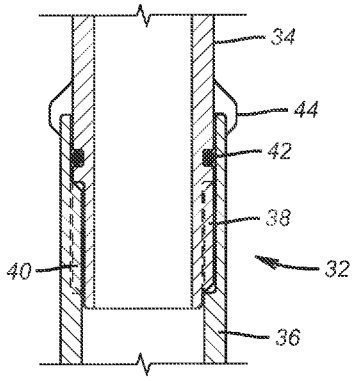
FIG. 2 is a schematic representation of a quick connector that seals and transmits torque without being threaded.
Figure 3:
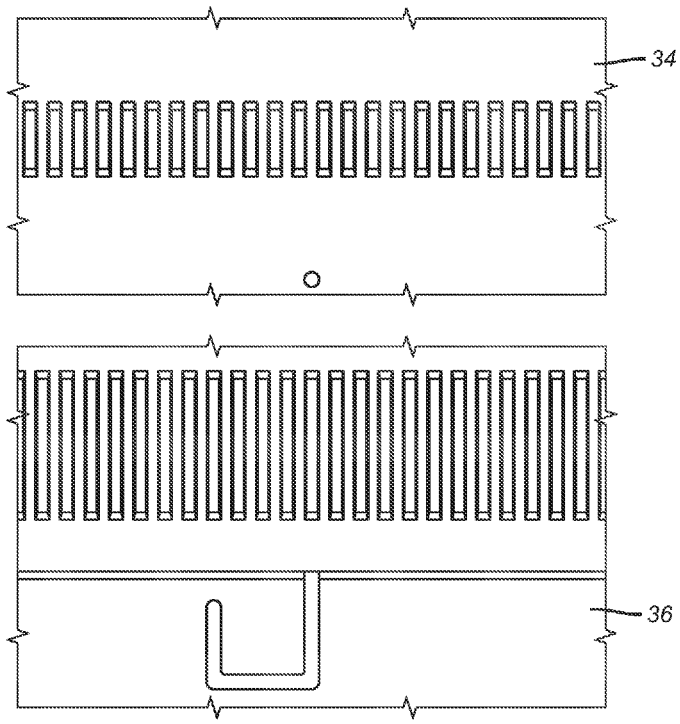
FIG. 3 is a schematic representation of a bayonet connection.
Figure 4:
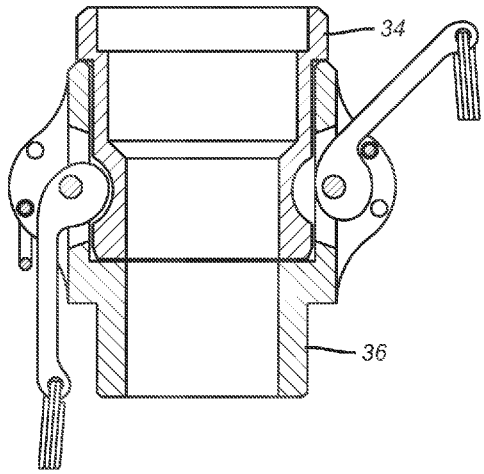
FIG. 4 is a schematic representation of a connection retained by an elongated element.

It is the connection between or among BHA components where connectors such as shown schematically in FIG. 2 come into play. The connector 32 can have a variety of designs that have common features. Those features are that the connectors 32 have in common is that they don't need threaded makeup, they seal when joined together, they transmit torque when joined together and they employ a locking system that is simple to operate at the surface but that securely holds the connection together to the pressure rating of the connected equipment. Such a design is schematically illustrated in FIG. 2. An upper end 34 of connection 32 is a part of one of the tools in the BHA. The lower end 36 is part of another tool in the BHA. When brought together ends 34 and 36 have splines 38 and 40 that engage to rotationally lock ends 34 and 36 together. A seal 42 spans the gap between the ends 34 and 36 in the region of overlap when they are brought together. Although the seal 42 is shown as a single o-ring there can be multiple seals for backup and they can be in a variety of styles and materials depending on the surrounding environment and the pressures and temperatures. The seal 42 can be chevron ring stacks as one example. There is also the clamping device 44 that holds the ends 34 and 36 together. While shown schematically in FIG. 2 many options are possible with an emphasis on security of the connection and simplicity in makeup. One way to join the ends 34 and 36 is a bayonet style connection as shown schematically in FIG. 3 involving a push together followed by a quarter turn to align shoulders that were misaligned to facilitate pushing the joint together. The engaged position can be secured with external lugs that align upon makeup so that a pin or other securing device such as a cable loop can be attached at the surface by rig personnel to keep the ends 34 and 36 from becoming undone as shown schematically in FIG. 4. Exterior clamp devices such as handles that bring dogs into a groove and whose locked position can be simply secured by surface personnel with a cable or some other locking device with a low profile that can be reasonably isolated from impact during running in or pulling out of the hole or during operations that involve rotation are also within the purview of the invention.

With the present invention tongs are not needed to make up a BHA that is to be used with coiled tubing. Frequently such equipment is not available at the well for a job run on coiled tubing and time can be saved in making up the components of the BHA to each other with the elimination of pin and box connections with a result that the connected components are quickly and safely made up and can transmit torque and can be just as simply undone after the BHA is pulled out of the hole.

The above description is illustrative of the preferred embodiment and many modifications may be made by those skilled in the art without departing from the invention whose scope is to be determined from the literal and equivalent scope of the claims below.

I claim:

1. A bottom hole assembly for subterranean use, comprising:

a coiled tubing string;

a bottom hole assembly supported by said string;

at least one connector having a first and a second connectable components to secure at least a portion of said bottom hole assembly to said coiled tubing string, said first component has a mounting end connected to said coiled tubing string and a first connection end on an opposed end thereof, said second component has a mounting end connected to said bottom hole assembly and a second connection end on an opposed end thereof;

said first and second connection ends are made up such that said first and second connection ends retain each other against axial separation by being brought together with a turn or less of relative rotation between said first and second connectable components such that said bringing together of said connectable components with said turn or less of relative rotation results in rotational locking between meshing splines adjacent said first and second connection ends and externally locking for prevention of axial separation of said connectable components for support of the weight of the bottom hole assembly from the coiled tubing string for running into a subterranean location.

2. The assembly of claim 1, wherein:

said connector comprises components that lock to each other after being brought together.

3. The assembly of claim 2, wherein:

said components are locked together with at least one movable handle that interlocks said components and whose locked position is secured.

4. The assembly of claim 3, wherein:

said locked position is secured with an elongated element passing through said handle and secured to one of said components.

5. The assembly of claim 2, wherein:

said components lock bayonet style with a projection on one component rotated to engage a recess on the other.

6. The assembly of claim 1, wherein:

said at least one connector comprises a plurality of connectors to secure the bottom hole assembly to said coiled tubing string as well as to secure one portion of said bottom hole assembly to another portion of said bottom hole assembly.

7. The assembly of claim 6, wherein:

said connectors comprise all the connections in said bottom hole assembly.

8. The assembly of claim 1, wherein:

said connector makes up without rotation.

9. The assembly of claim 8, wherein:

said connector comprises components that rotationally lock when brought together.

10. The assembly of claim 9, wherein:

said components lock to each other when pushed together.

11. The assembly of claim 10, wherein:

said connector comprises a plurality of connectors to secure the bottom hole assembly to said coiled tubing and to secure one portion of said bottom hole assembly to another portion of said bottom hole assembly.

12. The assembly of claim 11, wherein:

one of said connectors is used for every connection in said bottom hole assembly.

13. The assembly of claim 10, wherein:

said components comprise exterior members that come into alignment when said components are pushed together to allow locking said components to each other through said exterior members.

* * * * *